US005875888A

United States Patent [19]

Albisetti

[11] Patent Number: 5,875,888

[45] Date of Patent: Mar. 2, 1999

[54] DEVICE FOR SEPARATELY STORING TWO COMPONENTS, FOR MIXING THEM, AND FOR DISPENSING THE MIXTURE

[75] Inventor: Nicolas Albisetti, Clichy, France

[73] Assignee: L'Oreal, Paris, France

[21] Appl. No.: 897,537

[22] Filed: Jul. 21, 1997

[30] Foreign Application Priority Data

Aug. 2, 1996 [FR] France ..... 96 09821

[51] Int. Cl.[6] ..... B65D 25/08; B67D 5/56

[52] U.S. Cl. ..... 206/221; 206/568; 215/DIG. 8; 222/129; 222/145.5

[58] Field of Search ..... 222/129, 145.5, 222/207, 94, 529; 206/219, 221, 568; 215/DIG. 8

[56] References Cited

U.S. PATENT DOCUMENTS

| | | | |
|---|---|---|---|
| 2,813,649 | 11/1957 | Lipari | 206/221 X |
| 3,856,138 | 12/1974 | Maekawa et al. | 206/221 |
| 4,020,832 | 5/1977 | Kirkpatrick et al. | 206/219 X |
| 5,060,791 | 10/1991 | Zulauf | 206/221 |
| 5,088,627 | 2/1992 | Musel | 222/145.5 |
| 5,417,321 | 5/1995 | Halm | 206/221 |
| 5,613,623 | 3/1997 | Hildebrandt | 222/129 |
| 5,634,714 | 6/1997 | Guild | 206/221 X |

FOREIGN PATENT DOCUMENTS

| | | |
|---|---|---|
| A-0 243 730 | 11/1987 | European Pat. Off. . |
| U-86 24 488 | 2/1988 | Germany . |
| U-93 11 641 | 1/1995 | Germany . |
| WO 93/25446 | 12/1993 | WIPO . |

*Primary Examiner*—Bryon P. Gehman
*Attorney, Agent, or Firm*—Oliff & Berridge PLC

[57] ABSTRACT

A device for separately packaging two components, for mixing them together, and for dispensing the resulting mixture includes a two-compartment receptacle, a removable plug for separating the compartments during storage of the components until first use, a dispenser endpiece defining an outlet channel for the mixture, closure suitable for closing the outlet channel during storage of the components, and a drive member that is axially displaceable to drive relative displacement of the endpiece and the closure so as to open the outlet channel. The drive member also displaces the plug so as to put the compartments into communication with each other. The plug is connected to the drive member by a coupling member enabling the plug to be entrained over at least a portion of the axial displacement of the drive member so as to establish communication between the compartments.

10 Claims, 7 Drawing Sheets

DEVICE FOR SEPARATELY STORING TWO COMPONENTS, FOR MIXING THEM, AND FOR DISPENSING THE MIXTURE

The present invention relates to a device for packaging two components separately, for mixing them, and for dispensing the mixture obtained in this way.

BACKGROUND OF THE INVENTION

Numerous devices are already known for separately storing two components which are to be mixed extemporaneously on first use.

German utility model (Gebranchsmuster) G 8624488.4 discloses a device having one of its compartments constituted by a flask presenting an externally threaded neck at its top end, while its other compartment is formed by a tubular portion engaged inside said neck, closed at its bottom end by a removable plug, and provided at its top end with a dispensing endpiece defining an outlet channel that is closed by a closure cap. The plug is held by friction in said tubular portion and bears axially at its periphery against a shoulder formed at the base of said neck. A closure rod extends the plug upwards and engages in said outlet channel so long as the plug bears against said shoulder. This makes it possible to prevent the component contained in the tubular portion being distributed before it has been mixed with the component present in the flask. The tubular portion is secured to an external skirt in screw engagement on the thread of the neck and making it possible, when rotated in the unscrewing direction, to raise the tubular portion inside the neck. After the tubular portion has travelled over a predetermined upward stroke, the plug which is held axially by the shoulder formed at the base of the neck ceases to be held thereby, and drops into the flask, thus enabling the component contained in the tubular portion to mix with the component contained in the flask. That known device does not provide entire satisfaction, in particular because it is difficult to fill the tubular portion. Specifically, it is not possible to insert a substance via the dispensing endpiece when the plug is engaged in the tubular portion since the closure rod then closes the outlet channel. It is therefore necessary to fill the tubular portion before the plug has been put into place therein, and in that known device the threaded neck of the flask is made removable for that purpose. In addition, the tubular portion is filled with the dispensing endpiece pointing downwards, and closed by the closure cap. When the substance is in powder form, it can fill the outlet channel and subsequently interfere with putting the plug into place by preventing the closure rod being inserted in the outlet channel. When the substance is a liquid, traces of the liquid can remain in the outlet channel and that is disadvantageous when the substance is an irritant since the user can be exposed to the substance on unscrewing the closure cap.

OBJECTS AND SUMMARY OF THE INVENTION

The invention seeks to propose a novel device for separately packaging two components, for mixing them, and for dispensing the resulting mixture, which device is suitable for being manufactured and filled at low cost, and is also suitable for separately packaging a liquid or solid component that is an irritant in a manner that is completely safe, and that is reliable in use.

This is achieved by a device of the type comprising a two-compartment receptacle, a removable plug for separating the compartments during storage of said components until first use, a dispenser endpiece defining an outlet channel for the mixture, closure means such as a closure rod, for example, suitable for closing said outlet channel during storage of said components, and a drive member that is axially displaceable to drive relative displacement of the endpiece and the closure means so as to release said outlet channel, and displacement of the plug so as to put said compartments into communication with each other, wherein said plug is connected to the drive member by a coupling member enabling the plug to be entrained over at least a portion of the axial displacement of the drive member so as to establish communication between said compartments.

Unlike the above-mentioned known device, the plug does not need to be held axially against a shoulder of the receptacle during the displacement of the drive member, and the invention makes it easier to fill the compartments of the receptacle by substances that are in liquid or powder form.

In a particular embodiment of the invention, the closure means are secured to said plug.

In a particular embodiment of the invention, the drive member moves over a thread of the receptacle.

In particular embodiment of the invention, the drive member is designed to be moved axially away from the endpiece so as to put the two compartments into communication with each other.

In a variant, the drive member is designed to be moved axially together with the endpiece to put the two compartments into communication, and the drive member has relief suitable for coming into entraining contact with the coupling member after the drive member has been displaced axially through a distance greater than the insertion depth of the closure means in the outlet channel.

Preferably, the receptacle comprises a body formed as a single piece by molding, and having a constriction serving as a seat for said plug.

Preferably, said receptacle body is open at both ends.

The two openings of the receptacle body serve firstly to make it easier to make the body by injection blow-molding or by coextrusion blow-molding, and secondly to make it possible to control accurately the inside diameter of the constriction through which the compartments communicate. This makes it easier to ensure that the constriction is indeed sealed by the closure plug while the components are being stored separately. Also, such sealing can be tested before the compartments are filled, and filling can advantageously be performed via the respective openings of the receptacle body without any risk of one component contaminating the other.

In a particular embodiment of the invention, the coupling member has a cylindrical portion suitable for sliding in sealed manner in the receptacle.

BRIEF DESCRIPTION OF THE DRAWINGS

Other characteristics and advantages of the present invention appear on reading the following description of non-limiting embodiments of the invention, and on examining the accompanying drawings, in which.

MORE DETAILED DESCRIPTION

Figure 1:
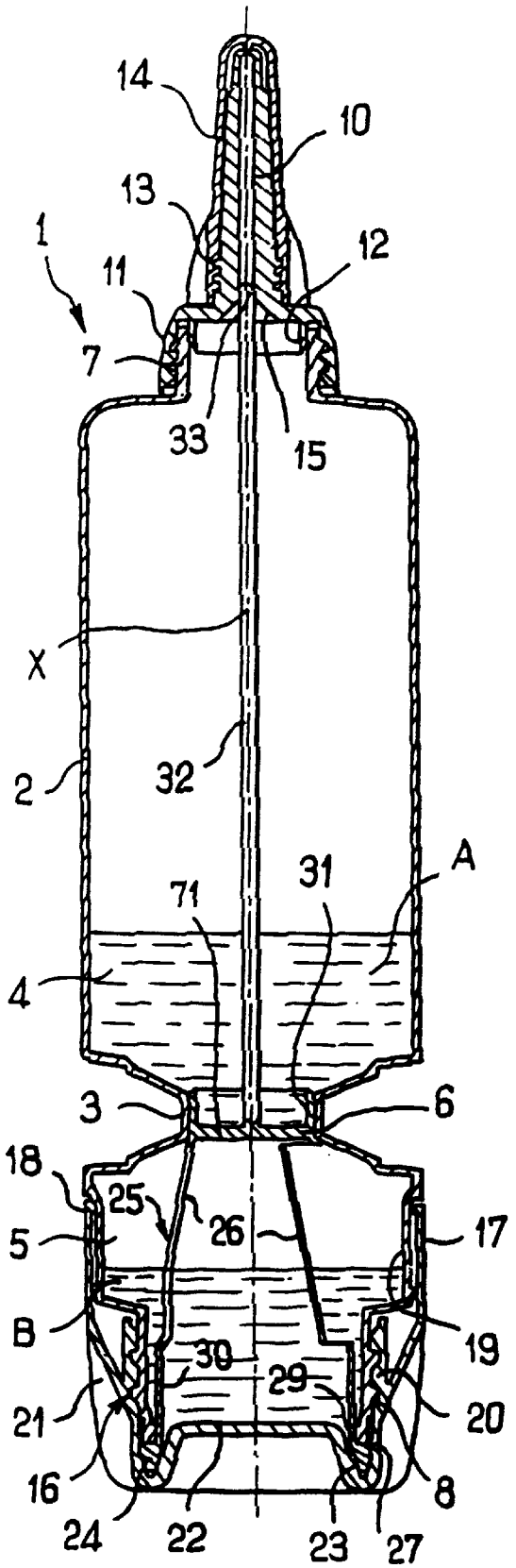
FIG. 1 is a diagrammatic axial section view of a device constituting a first embodiment of the invention, before its components are mixed together.
Figure 2:
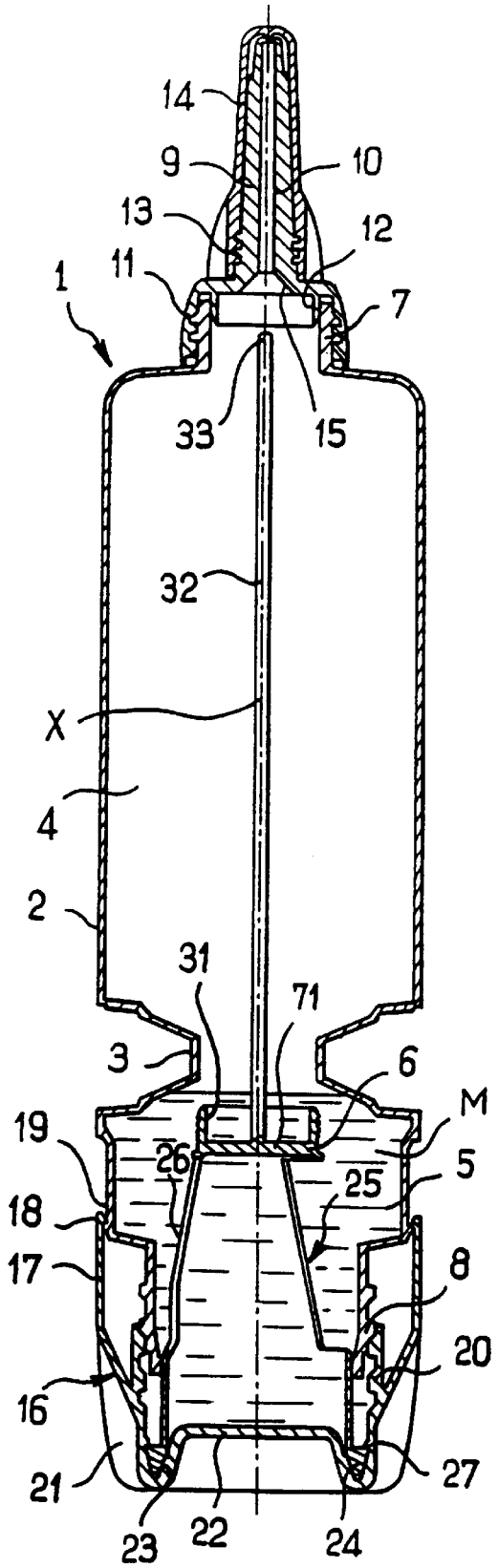
FIG. 2 is a view analogous to FIG. 1, showing the device after the components have been mixed together.

FIGS. 1 and 2 show a device 1 constituting a first embodiment of the invention.

The device 1 comprises a body 2 having a constriction 3 uniting a top compartment 4 with a bottom compartment 5, which compartments are designed to contain respective components A and B before first use. A plug 6 fits in the constriction 3 to separate the top and bottom compartments 4 and 5 and to allow the components A and B to be stored separately.

The body 2 is elongate along a longitudinal axis X which is generally circularly cylindrical in shape about said axis and which has externally threaded necks 7 and 8 at its two axial ends.

The body 2 is advantageously made by injection blow-molding a plastics material that is chemically compatible with the components that are to be packaged therein. By way of indication, if one of the components is thioglycolic acid, as used in hairdressing for making permanent wave preparations, the body 2 is advantageously made by injection blow-molding PVC or by coextrusion blow-molding a multilayer PE/EVOH/PE structure. The use of a multilayer structure makes it possible to combine chemical resistance with mechanical strength while also making it possible to benefit from improved appearance, where appropriate. It should also be observed that the relatively simple shape of the body 2 makes it relatively easy to control its wall thickness.

A dispenser endpiece 9 defining an outlet channel 10 is screwed onto the neck 7 via an internally threaded base 11. The base 11 is provided with an annular sealing lip 12 which fits against the radially inner surface of the neck 7. The endpiece 9 is provided with a thread 13 enabling a closure cap 14 to be screwed thereon. The outlet channel 10 opens out downwardly into the compartment 4 via a conical outlet 15 which flares towards the inside of the receptacle.

A drive member 16 serves to displace the plug 6 in the body 2 in order to put the top and bottom compartments 4 and 5 into communication with each other and allow the components A and B to be mixed together. The drive member 16 has an outer skirt 17 fitted at its end with an annular rim 18 that is snap-fastened in an annular retaining groove 19 formed in the outside surface of the wall of the body 2 that defines the side of the bottom compartment 5. The drive member 16 also includes an inner skirt 20 having an inside thread for screwing onto the neck 8 to transform rotation of the drive member 16 into axial displacement thereof along the axis X. Fins 21 are formed on the outside surface of the skirt 17 to make it easier for the user to grip the drive member 16. The skirt 17 is connected to a bottom 22 via a groove 23 for receiving an annular rim 24 of substantially complementary shape formed at the bottom end of a coupling member 25 whose top end is secured to the plug 6.

The coupling member 25 is hollow, and its side wall has slots 26 passing through its upper portion enabling the component B contained in the coupling member 25 to reach the remainder of the compartment 5. The groove 23 has a retaining shoulder 27 enabling the coupling member 25 to be entrained when the drive member 16 is unscrewed on the neck 8. In the vicinity of its free edge, and on its radially inner surface, the neck 8 has an annular rim 29 bearing against the bottom portion 30 of the coupling member 25. This bottom portion 30 is circularly cylindrical and slides in sealed manner in contact with the rim 29. The rim 24 is downwardly tapering in shape, thereby improving sealing where it is fixed in the groove 23.

The plug 6 has a transverse wall 71 connected at its periphery to an annular sealing lip 31 extending upwardly and shaped to be a close fit in the constriction 3 so as to separate the compartments 4 and 5 during storage. The bottom face of the transverse wall 71 is connected to the coupling member 25 and the top face thereof is extended upwards from its center by a closure rod 32 passing axially through the top compartment 4. The rod 32 has a top end 33 shaped to engage in the outlet channel 10 when the plug 6 is fitted in the constriction 3, thereby closing the outlet channel.

The thread on the neck 8 is designed so that rotation of the drive member 16 is accompanied by axial displacement thereof together with the plug 6 through a distance that is greater than the insertion depth of the end 33 in the outlet channel 10, such that when the drive member 16 has completed its rotation, the end 33 of the closure rod has disengaged the outlet channel 10, as shown in FIG. 2.

While the device is being assembled and filled, the first step is to place the plug 6 in the constriction 3 of the body 2 by inserting the plug 6 together with the closure rod 32 and the coupling member 25 through the opening in the neck 8. It is advantageous at this stage of manufacture to test sealing between the compartments 4 and 5. Thereafter, the top compartment 4 can be filled with component A and the dispenser endpiece 9 fitted with the closure cap 14 can be screwed onto the neck 7. The body 2 is turned upside-down and the compartment 5 can be filled with component B, the slots 26 enabling the substance inserted into the coupling member 25 to reach the remainder of the compartment 5. After the compartment has been filled with component B, the drive member 16 is fitted to the neck 8 and is screwed thereon until the rim 18 engages in the annular groove 19 and the rim 24 snaps into the groove 23.

While the plug 6 separates the compartments 4 and 5, the user cannot dispense component A because the rod 32 closes the outlet channel 10. It is thus possible to fill the compartment 4 with a substance that is an irritant or that is corrosive without any risk for the user in the event of the cap 14 being prematurely unscrewed.

To use the device, the user turns the drive member 16 in the direction to unscrew it from the threaded neck 8. The coupling member 25 is entrained axially downwards in FIG. 2 by the shoulder 27, until the rim 18 comes into axial abutment against the bottom edge of the groove 19. The plug 6 is moved downwards through the same axial stroke as the drive member 16 and releases the constriction 3, thereby enabling the mixture M to be formed in the bottom compartment 5. The closure rod 32 is moved together with the plug 6 and releases the outlet channel 10 of the dispenser endpiece 9. The user can then extract the mixture M through the dispenser endpiece 9, after removing the cap 14.

The device 1 is put into its position for use merely by rotating the drive member.

Figure 3:
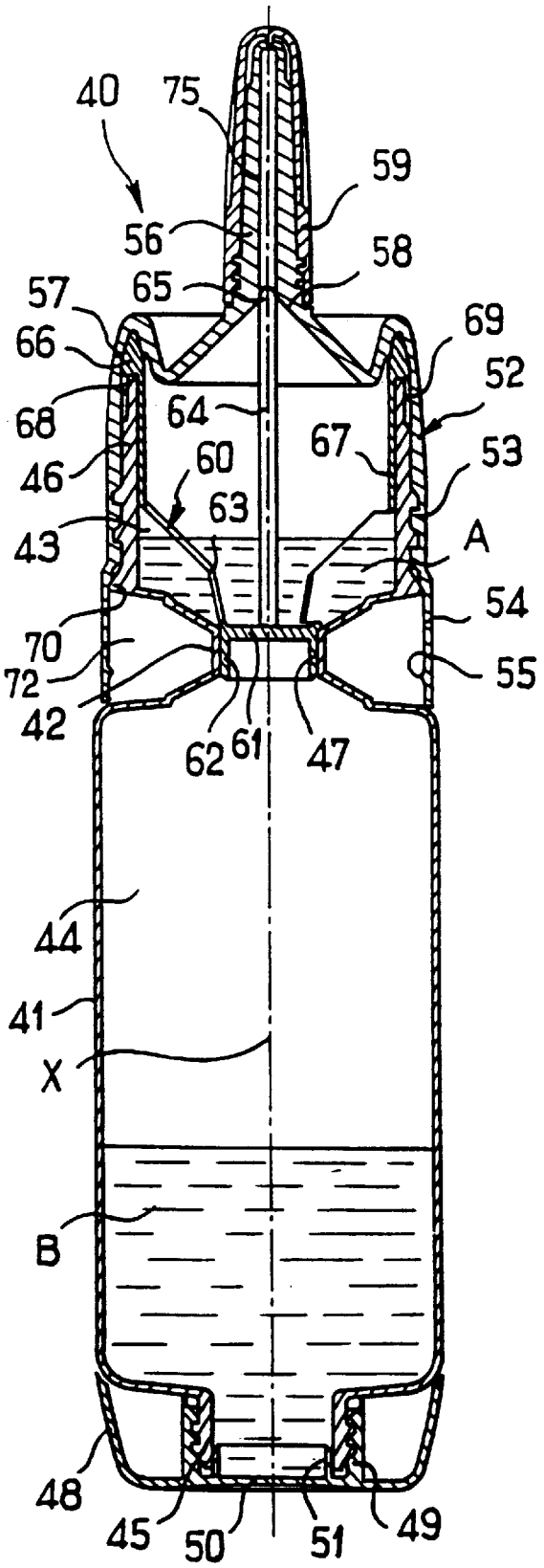
FIG. 3 is a diagrammatic axial section view of a device constituting a second embodiment of the invention, before the components have been mixed together.
Figure 4:
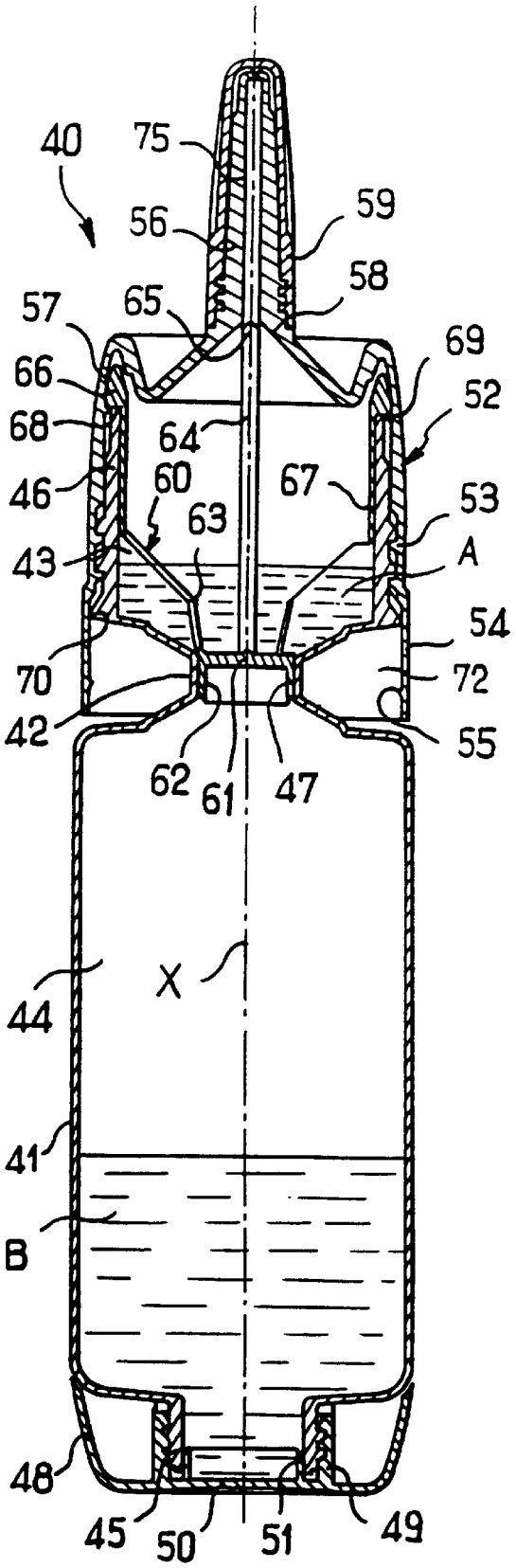
FIGS. 4 and 5 are views analogous to FIG. 3, showing the device during various stages of first use.
Figure 5:
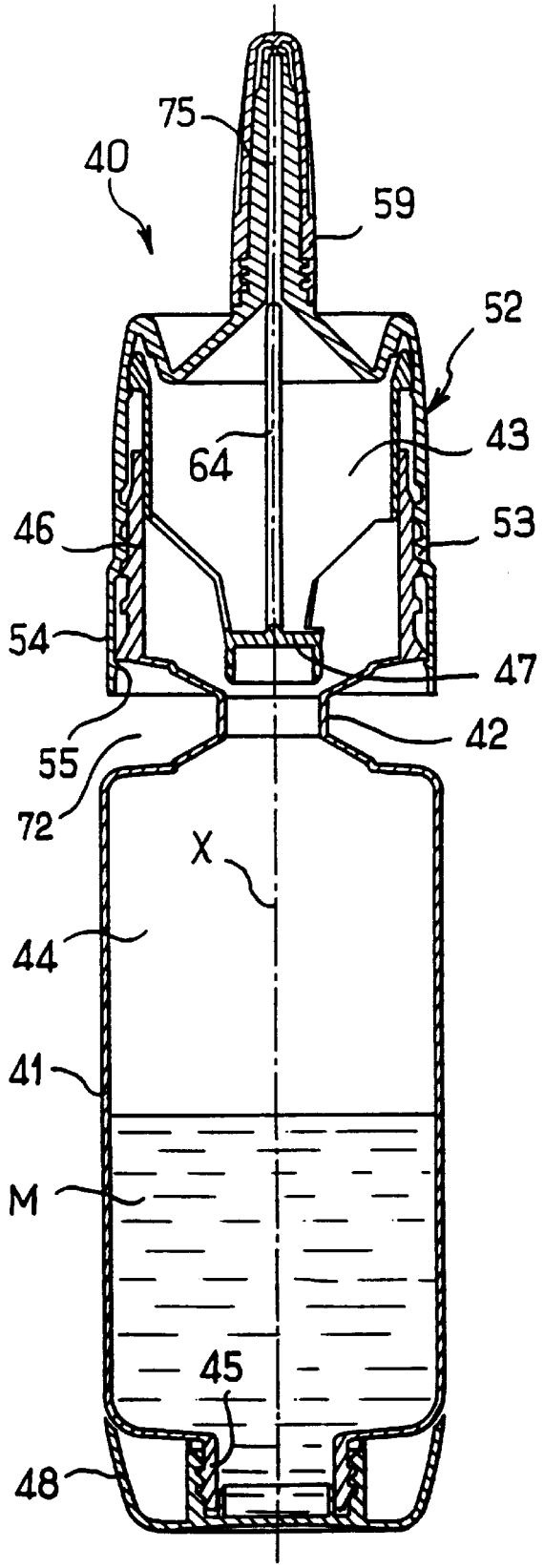

FIGS. 3 to 5 show a device 40 constituting a second embodiment of the invention.

The device 40 comprises a body 41 having a constriction 42 through which top and bottom compartments 43 and 44 can communicate. The body 41 is elongate in shape along a longitudinal axis A and has externally threaded necks 45 and 46 at its axial ends. The inside surface of the neck 46 defines the side of the compartment 43. A plug 47 having a transverse wall 61 makes it possible to separate the compartments 43 and 44 during separate storage of the components A and B.

An end part 48 is screwed to the neck 45 to close the bottom of the compartment 44. This end part 48 has an outer skirt extending the cylindrical wall of the body 41 which defines the side of the compartment 44, and it has an inner skirt 49 with an inside thread shaped to screw onto the neck 45. The inner skirt 49 is connected to an end wall 50 extending transversely to the axis X and from which an annular sealing rim 51 projects upwardly, which lip is shaped to fit against the radially surface of the neck 45 to obtain sealed closure of the bottom end of the body 41. Catches are provided on the skirt 49 to co-operate with projections formed at the base of the neck 45 and prevent the user from unscrewing the part 48.

A drive member 52 is screwed onto the neck 46 to entrain displacement of the plug 47 and put the compartments 43 and 44 into communication on first use of the device. The drive member 52 has an outer skirt whose top portion 53 has an inside thread and whose bottom portion 54 is enlarged and is provided on its radially inner surface with an annular rim 55 shaped to snap into the annular groove 72 formed around the constriction 42 of the body 41 between the compartments 43 and 44.

The drive member 52 is integrally formed out of the same plastics material as a dispenser endpiece 56 connected to the portion 53 and co-operating therewith to form a groove 57. The endpiece 56 defines an outlet channel 75 opening to the inside of the top compartment 43 via an outlet 58 that flares towards the compartment 43. The endpiece 56 is externally threaded to receive a closure cap 59.

A coupling member 60 is engaged at its top end in the above-mentioned groove 57 and is connected at its bottom end to the plug 47. The plug has a transverse wall 61 that is extended downwardly by an annular sealing lip 62 coming into contact with the constriction 42 to provide sealed separation of the compartments 43 and 44. The coupling member 60 is hollow and it is provided in its bottom portion with lateral slots 63 to enable the substance to pass from the inside of the coupling member 60 into the remainder of the top compartment 43. The top portion of the coupling member 60 has a circularly cylindrical wall 67 that fits closely in the neck 46 so as to slide in sealed manner therein.

The transverse wall 61 of the plug 47 is extended upwardly, in its center, by a closure rod 64 passing through the compartment 43 and presenting a top end 65 that is shaped to engage in the bottom end of the outlet channel 75 when the plug 47 is in place in the constriction 3, as shown in FIG. 3.

This prevents unmixed component A being dispensed if the cap 59 is unscrewed.

At its top end, the coupling member 60 has an upwardly tapering annular rim 66 that fits in sealed manner in the groove 57 and that co-operates with the wall 67 to form a shoulder 68. The outer skirt of the drive member 52 has an inside shoulder 69 suitable for bearing axially against the shoulder 68 of the rim 66 to entrain the coupling member 60 upwards together with the drive member 52.

The device 40 is assembled and filled as follows.

Initially the plug 47 is placed in the constriction 42 by being inserted through the neck 46. Thereafter, the body 41 can be turned the other way up and the compartment 44 can be filled through the neck 45. After the compartment 44 has been filled with component B, the compartment is closed by screwing on the end part 48. Thereafter, the body 41 is turned the other way up and the compartment 43 is filled with component A which can pass through the lateral slots 63 in the coupling member 60. Once the compartment 43 has been filled, the drive member 52 is applied to the neck 8, the annular rim 55 passing resiliently over a rim 70 formed at the bottom end of the neck 46. When the drive member 52 is in place on the body 41, the annular rim 66 is fully engaged in the groove 57 and it is held to press axially against the top end edge of the neck 46 by the drive member 52. The closure rod 65 penetrates into the outlet channel 75 to close it.

To use the device, the user turns the drive member 52 in the direction for unscrewing it from the neck 46. When the drive member begins to rotate, the shoulder 69 rises until it bears against the shoulder 68 of the rim 66, as shown in FIG. 4. During this displacement of the drive member, the plug 47 remains stationary relative to the body 41. The drive member is displaced through a distance that is greater than the depth of engagement of the closure rod 64 in the outlet channel 75 so that the channel is no longer closed by the end 65 of the closure rod 64. Thereafter, with the user continuing to rotate the drive member 52, it comes into abutment via the shoulder 69 against the shoulder 68 and entrains in its axial displacement the coupling member 60, thereby disengaging the constriction 42 of the body 41. At the end of drive member rotation, as shown in FIG. 5, component A has dropped and mixed with component B to obtain mixture M. The outlet channel 65 is disengaged so the user can extract mixture M by unscrewing the closure cap 59.

Figure 6:
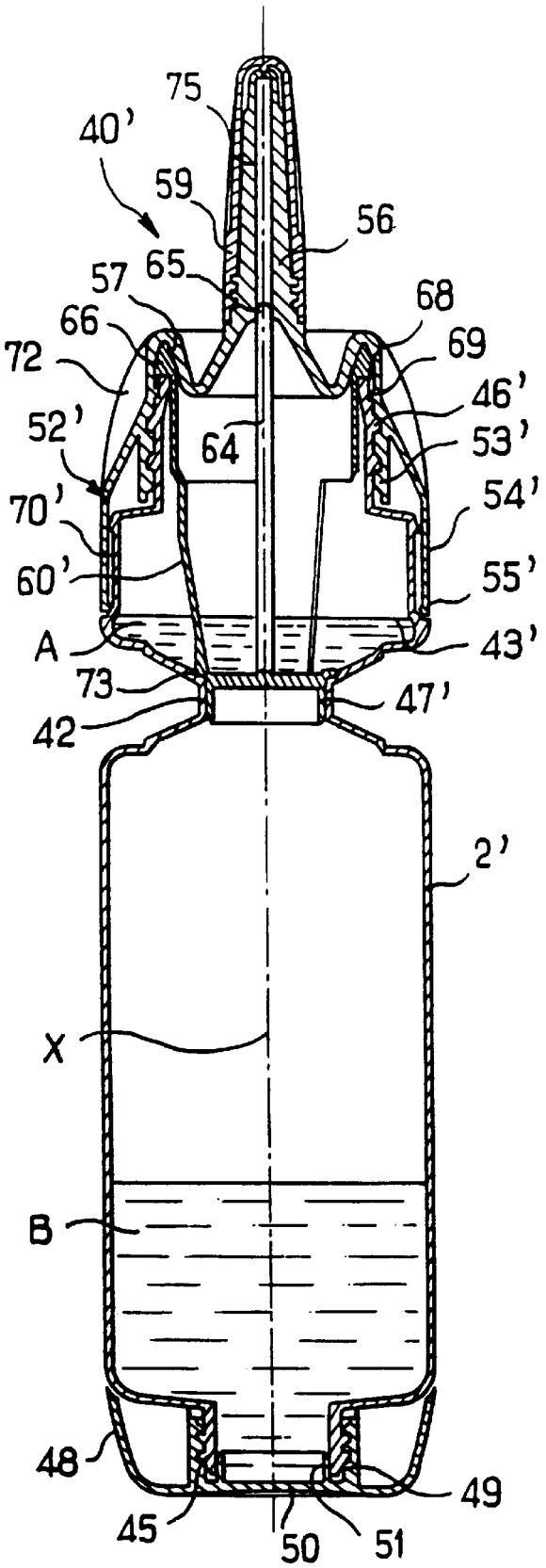
FIG. 6 is a diagrammatic axial section view of a device constituting a third embodiment of the invention.
Figure 7:
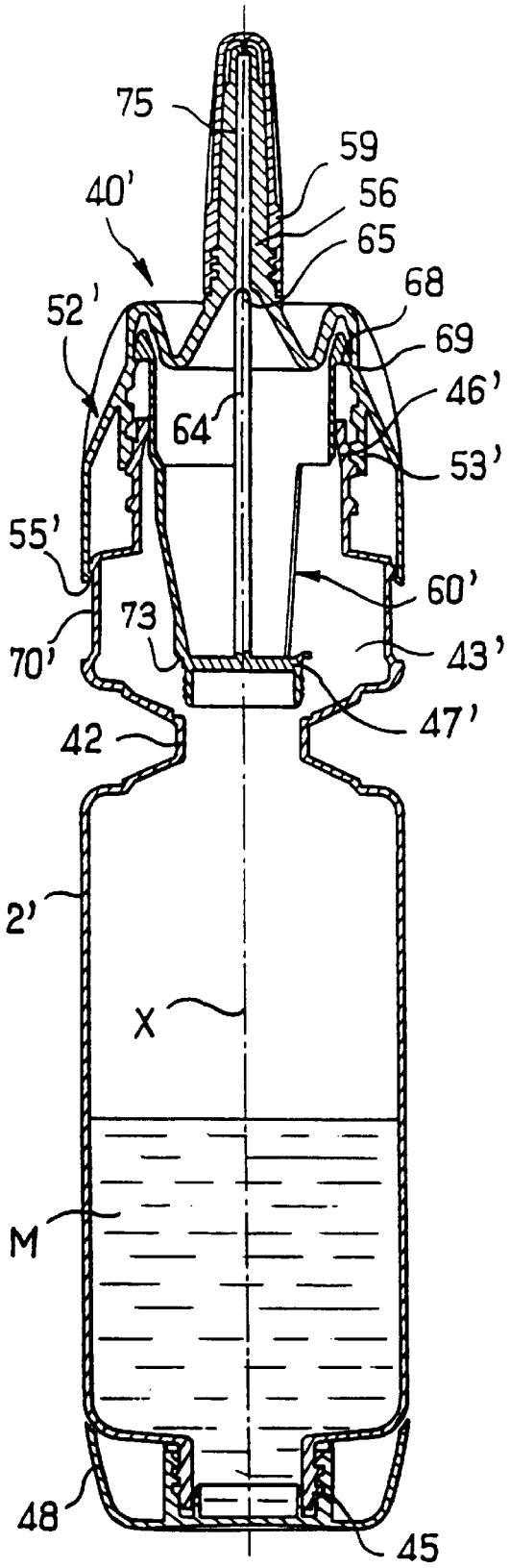
FIG. 7 is a view analogous to FIG. 6, showing the device after the components have been mixed together.

FIGS. 6 and 7 show a device 40' constituting a third embodiment of the invention.

The same reference symbols are given to elements that are identical or functionally analogous to those of the above-described embodiment, so the description is not repeated in detail.

The bottom portion of the device 40' is identical to that of the device 40. The top portion of the device 40' differs from that of the device 40 specifically in the shapes of the plug 47', of the coupling member 60', of the drive member 52', and of the body 41'.

The drive member 52' has an inner skirt 53' with an inside thread shaped to screw onto the neck 46' of the body 41', and an outer skirt 54' of diameter greater than that of the inner skirt 53' and provided at its end with an annular rim 55' projecting radially inwards. This annular rim 55' is retained in an annular groove 70' formed on the outer surface of the wall of the body 41' defining the side of the bottom portion of the compartment 43'.

Where the plug 47' is connected to the coupling member 60', it defines a shoulder 73 shaped to bear axially against a shoulder of complementary shape on the bottom portion of the compartment 43', when the plug 47' is in place in the constriction 42. The coupling member can be compressed axially to a small extent when the plug 47' and the drive member 52' are in place, so as to improve the sealing of the closure of the compartment 43'. Advantageously, the drive member 60' can deform elastically under the effect of such axial compression.

The drive member 52' is provided on its outer surface with ribs 72 which make the drive member 52' easier for the user to grip.

The device 40' is assembled and filled in a manner that is substantially identical to that described for the device 40, with the exception that the drive member 52' is retained on the body 41' at the end of its rotary displacement causing the components A and B to be mixed, by the annular rim 55' coming into abutment against the top edge of the annular groove 70', as shown in FIG. 7.

Naturally, the invention is not limited to the embodiment described above.

Specifically, the shape of the receptacle can be modified and the receptacle need not be formed as a single piece, but could comprise an assembly of two separately-manufactured pieces.

I claim:

1. A device for separately packaging two components, for mixing them together, and for dispensing the resulting mixture, the device comprising a two-compartment receptacle, a removable plug for separating the compartments during storage of the components until first use, a dispenser endpiece defining an outlet channel for the mixture, closure means movable relative to the receptacle and to the endpiece and suitable in a first position relative to the endpiece and to the receptacle for closing said outlet channel during storage of the components, and a drive member that is axially displaceable to drive displacement of the closure means into a second position relative to the endpiece and to the receptacle, in which the outlet channel is no longer closed by said closure means, and displacement of the plug so as to put said compartments into communication with each other, wherein said plug is connected to the drive member by a coupling member enabling the plug to be entrained over at least a portion of the axial displacement of the drive member so as to establish communication between said compartments.

2. A device according to claim 1, wherein said closure means are secured to said plug.

3. A device according to claim 1, wherein said drive member moves over a thread of the receptacle.

4. A device according to claim 1, wherein the drive member is designed to be moved axially away from the endpiece so as to put the two compartments into communication with each other.

5. A device according to claim 1, wherein said drive member is integrally molded with said dispenser endpiece.

6. A device according to claim 1, wherein said receptacle comprises a body formed as a single piece by molding and having a constriction serving as a seat for said plug.

7. A device according to claim 6, wherein the receptacle is open at both ends.

8. A device according to claim 1, wherein said coupling member has a cylindrical portion suitable for sliding in a sealed member in the receptacle.

9. A device according to claim 1, wherein one of said compartments is filled with a substance that is an irritant.

10. A device for separately packaging two components, for mixing them together, and for dispensing the resulting mixture, the device comprising a two-compartment receptacle, a removable plug for separating the compartments during storage of the components until first use, a dispenser endpiece defining an outlet channel for the mixture, closure means suitable for closing said outlet channel during storage of the components, and a drive member that is axially displaceable to drive relative displacement of the endpiece and the closure means so that the outlet channel is no longer closed by the closure means, and displacement of the plug so as to put said compartments into communication with each other, wherein said plug is connected to the drive member by a coupling member enabling the plug to be entrained over at least a portion of the axial displacement of the drive member so as to establish communication between said compartments, the closure means is inserted into said outlet channel to an insertion depth, and the drive member is shaped for coming into entraining contact with the coupling member after the drive member has been displaced axially through a distance greater than the insertion depth of the closure means in the outlet channel.

* * * * *